US005586910A

United States Patent [19]

Del Negro et al.

[11] Patent Number: 5,586,910

[45] Date of Patent: Dec. 24, 1996

[54] CLAMP NUT RETAINING FEATURE

[75] Inventors: James Del Negro, Woodbury; Russell Brown, Oakville; Roger Avery, Danbury, all of Conn.

[73] Assignee: Amphenol Corporation, Wallingford, Conn.

[21] Appl. No.: 514,227

[22] Filed: Aug. 11, 1995

[51] Int. Cl.[6] ..... H01R 17/04

[52] U.S. Cl. ..... 439/584

[58] Field of Search ..... 439/578, 583, 439/584, 320, 321, 461, 462

[56] References Cited

U.S. PATENT DOCUMENTS

| | | | |
|---|---|---|---|
| Re. 19,628 | 7/1935 | Dodge | 285/25 |
| 1,672,879 | 6/1928 | Campbell . | |
| 2,417,350 | 3/1947 | Conroy | 29/148.2 |
| 2,755,451 | 7/1956 | Smyers . | |
| 2,808,643 | 10/1957 | Weatherhead | 29/508 |
| 2,870,420 | 1/1959 | Malek . | |
| 3,104,145 | 9/1963 | Somerset . | |
| 3,171,707 | 3/1965 | Powell . | |
| 3,184,706 | 5/1965 | Atkins . | |
| 3,262,188 | 7/1966 | Briegel et al. | 29/157 |
| 3,320,575 | 5/1967 | Brown et al. . | |
| 3,334,406 | 8/1967 | Bennett | 29/407 |
| 3,501,737 | 3/1970 | Harris . | |
| 3,644,874 | 2/1972 | Hutter . | |
| 3,671,926 | 6/1972 | Nepovim . | |
| 3,846,738 | 11/1974 | Nepovim . | |
| 3,907,399 | 9/1975 | Spinner . | |
| 3,910,673 | 10/1975 | Stokes . | |
| 3,963,320 | 6/1976 | Spinner . | |
| 3,963,321 | 6/1976 | Burger et al. . | |
| 4,076,367 | 2/1978 | Avins . | |
| 4,093,335 | 6/1978 | Schwartz et al. . | |
| 4,156,554 | 5/1979 | Aujea | 439/548 |
| 4,346,958 | 8/1982 | Blanchard . | |
| 4,566,167 | 1/1986 | Wolniak et al. | 29/437 |
| 4,575,274 | 3/1986 | Hayward | 403/2 |
| 4,583,811 | 4/1986 | McMills . | |
| 4,808,124 | 2/1989 | Spinner et al. | 439/578 |
| 4,830,628 | 5/1989 | Dyson et al. | 439/584 |
| 4,888,862 | 12/1989 | Brandenstein et al. | 29/148.4 |
| 4,973,265 | 11/1990 | Heeren | 439/584 |
| 5,011,432 | 4/1991 | Sucht et al. | 439/584 |
| 5,059,139 | 10/1991 | Spinner | 439/583 |
| 5,083,943 | 1/1992 | Tarrant | 439/583 |
| 5,340,332 | 8/1994 | Nakajima et al. | 439/584 |
| 5,352,134 | 10/1994 | Jacobsen et al. | 439/584 |

FOREIGN PATENT DOCUMENTS

| | | |
|---|---|---|
| 912672 | 10/1972 | Canada . |
| 3-95876 | 4/1991 | Japan . |
| 810556 | 3/1959 | United Kingdom . |
| 2087666 | 5/1982 | United Kingdom . |

*Primary Examiner*—Gary F. Paumen
*Assistant Examiner*—Jill Demello
*Attorney, Agent, or Firm*—Bacon & Thomas

[57] ABSTRACT

A rear clamping nut retaining feature for a hardline connector includes a rear nut having a compression ring retained therein in such a manner that the compression ring is able to move axially within the rear nut. The inner peripheral surface of the nut has an axially extending protrusion which when the compression ring is forced into an opening in the rear nut the protrusion deforms radially inward into a slot located on the outer peripheral surface of the compression ring thus holds it in place. The size of the protrusion and the size of the slot are related such that the volume of the protrusion is less than the volume of the groove to thereby allow the desired axial movement of the rear nut and compression ring.

6 Claims, 5 Drawing Sheets

FIG. 2
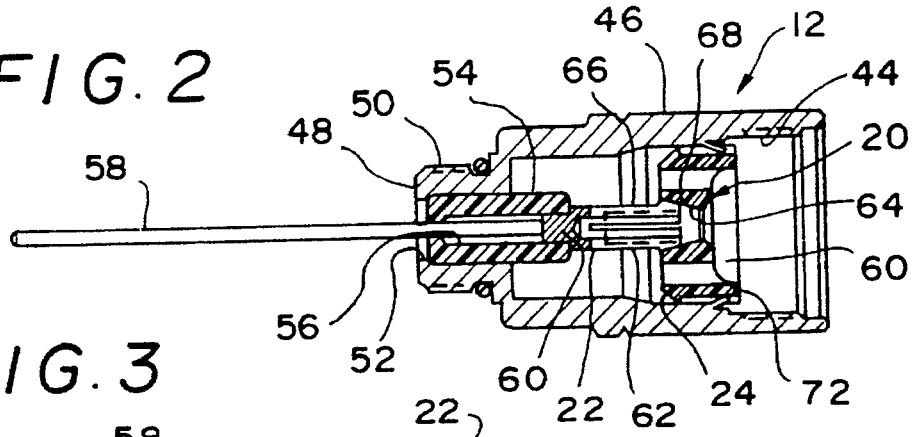
FIG. 3
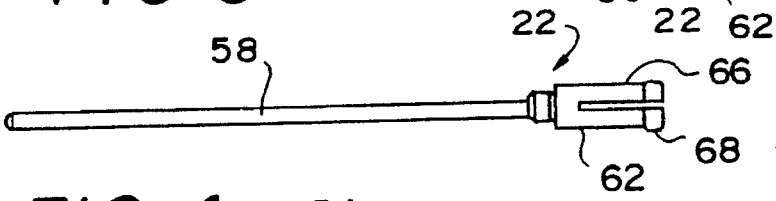
FIG. 4
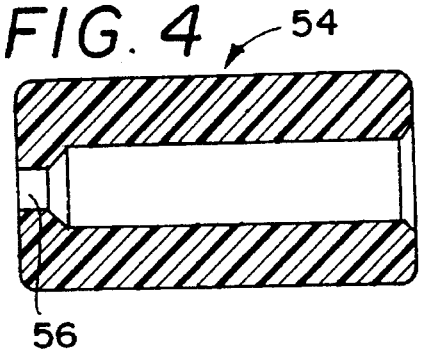
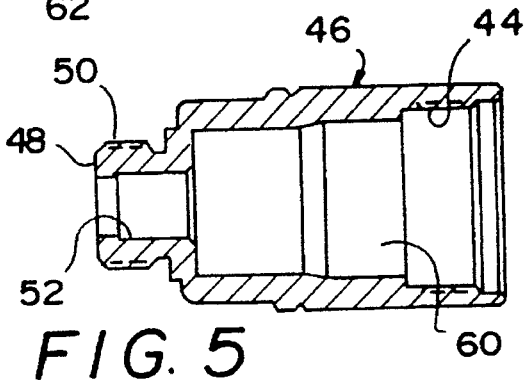
FIG. 5
FIG. 7
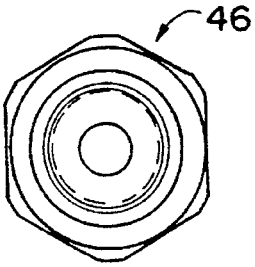
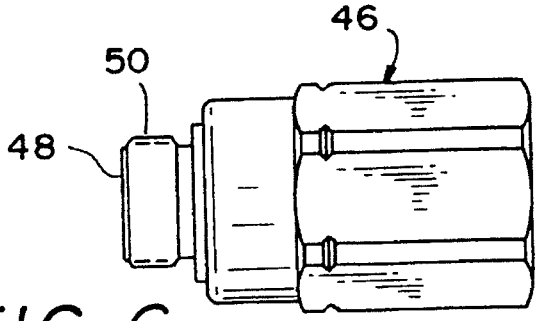
FIG. 6
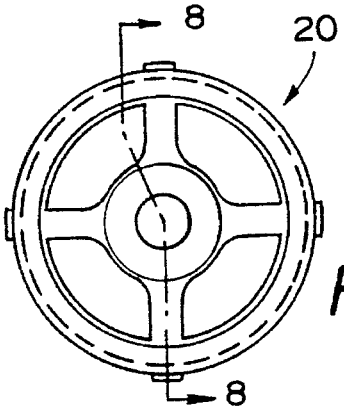
FIG. 9
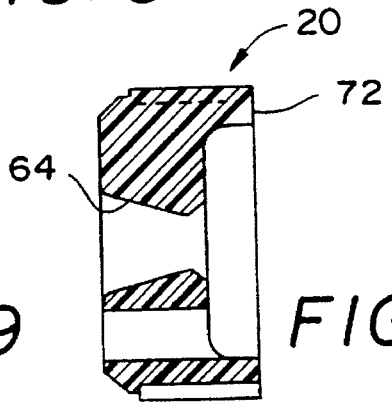
FIG. 8

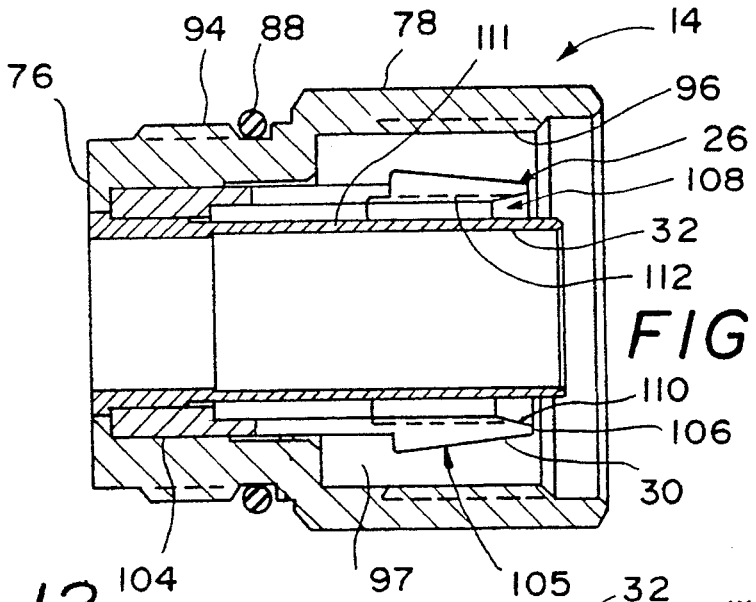
FIG. 10
FIG. 12
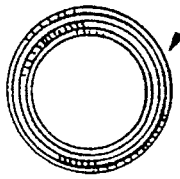
FIG. 11
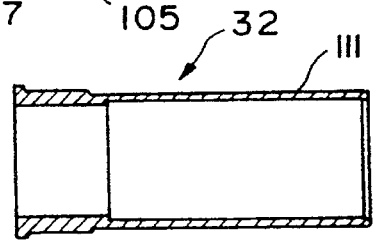
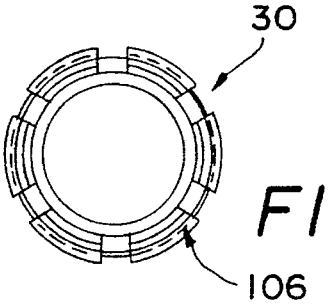
FIG. 14
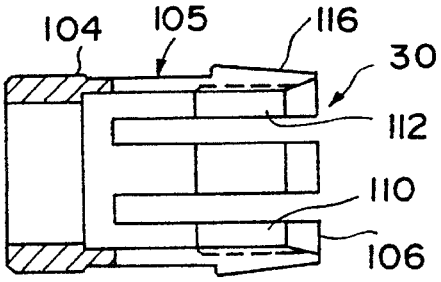
FIG. 13
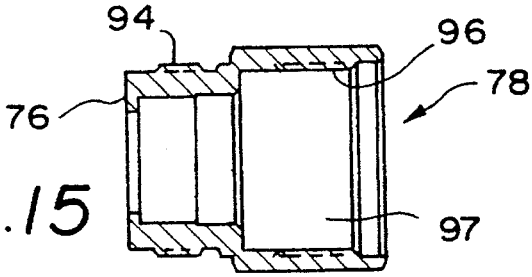
FIG. 15
FIG. 17
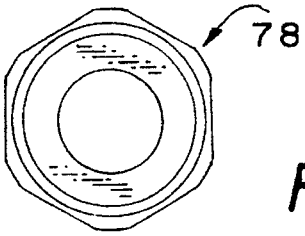
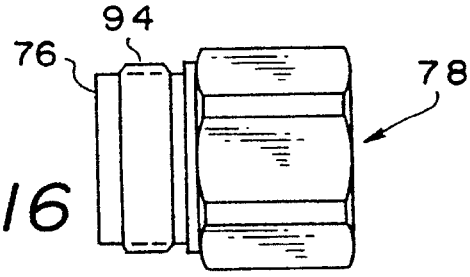
FIG. 16

CLAMP NUT RETAINING FEATURE

BACKGROUND OF THE INVENTION

1. Field of the Invention

This invention relates to the field of electrical connectors, and in particular to the clamp nut retaining mechanism suitable for use in a two or three piece hardline connector.

2. Description of Related Art

In a known two or three piece hardline connector, such as the one described in U.S. patent application Ser. No. 08/338,776, filed on Nov. 10, 1994, and incorporated herein by reference, the connector is secured to the shield of the cable by a clamping mechanism in which a tapered clamping ring secured to a rear clamping nut is used to cam a gripper mechanism onto the cable as the clamping ring is moved axially in response to rotation of the clamping nut.

In order to ensure proper operation of the camming mechanism and to permit sealing of the parts through o-ring compression, it is conventional in the known connector to provide for axial movement between the clamping ring and the clamping nut, and as a result the clamping ring of the known connector is secured to the clamping nut by means of a slot and snap ring arrangement which allows some play between the secured-to elements.

In this arrangement for securing the clamping nut to the clamping ring of a hardline cable connector, a portion of which is shown in the attached FIG. 21, the rear clamping nut is of essentially cylindrical hollow configuration and is formed with a first hole into which a compression ring may slide. An O-Ring is sandwiched between the compression ring and the rear clamping nut in order to form an environmental seal between the two. The rear clamping nut has a slot or groove formed on its inner peripheral surface and the compression ring has a corresponding slot or groove formed on its outer peripheral surface. A snap ring is placed within the two slots in order to retain the compression ring within rear clamping back nut until final assembly.

While this type of slot and snap ring retaining mechanism performs adequately, manufacture is relatively expensive and time consuming because of the recessing and slotting operations required, and the number of pans involved.

SUMMARY OF THE INVENTION

It is accordingly an objective of the invention to provide an arrangement for securing a clamping nut to a clamping ring which, like the conventional snap ring arrangement, allows relative movement between the nut and ring but which is easier and less costly to manufacture.

It is also objective of the invention to provide an arrangement for securing two members together with relative axial movement between the members, but without the need for recessed bores or the use of a snap ring.

It is yet another objective of the invention to simplify the manufacture of a clamping mechanism for a hardline cable connector which grips the cable without significant axial or radial deformation, and at the same time will prevent relative rotation between the cable and the connector during assembly of the cable to the connector.

It is a still further objective of the invention to provide an anti-rotation clamping mechanism for a CATV hardline connector which has a minimum number of parts in either a two or three piece configuration.

These objectives are achieved by providing an anti-rotation clamping mechanism for a hardline connector in which the outer conductor gripping mechanism is operated in cooperation between tapered surfaces on a gripper ring and a separate compression ring positioned to move axially in response to tightening of the real clamping nut, and the separate tapered compression ring is retained within the rear clamping nut by means of a trepan cold formed protrusion which upon placing the compression ring within the rear clamping nut, forms into an annular slot located on the outer peripheral surface of the compression ring.

This trepan retaining feature thus holds the compression ring within the rear clamping nut such that the compression ring can move axially relative to the nut, eliminating the need for a retaining ring or an internal slot on the inner peripheral surface of the back nut as was necessary in previous designs. In addition to the annular trepan protrusion which extends axially along the inner peripheral surface of the tubular rear clamping nut, there is a radially extending face which provides a surface against which the rearward end of the tapered compression ring may abut. When the annular compression ring is forced into the rear clamping nut and against this abutting surface, the trepan feature deforms radially inward into the annular slot of the outer peripheral surface of the compression ring thus retaining it in place, while the abutment of the end of the annular compression ring against the radically extending face prevents over deformation of the trepan protrusion and obviates the need for controlling the exact amount of axial force applied to the compression ring to deform the trepan feature the appropriate amount.

Additional objects, features and advantages of the present invention will be more readily apparent, from the following description of the preferred embodiment thereof, taken in conjunction with the drawings appended hereto, wherein like reference numerals refer to corresponding parts in the several views.

BRIEF DESCRIPTION OF THE DRAWINGS

FIG. 1 (A) is a cross-sectional view of a hardline cable assembly.

FIG. 2; is a cross-sectional side view of a main body for use in the connector of FIG. 1;

FIG. 3 is a side view of a center contact used in the main body assembly of FIG. 2;

FIG. 4 is a cross-sectional side view of a dielectric member for use in the main body assembly of FIG. 2;

FIG. 5 is a cross-sectional side view of a main body for use in the main body assembly of FIG. 2;

FIG. 6 is a side view of the main body for use in the main body assembly of FIG. 2;

FIG. 7 is a cross-sectional plan view of the main body shown in FIG. 6;

FIG. 8 is a cross-sectional view of a clamp actuation member for use in the main body assembly of FIG. 2 and is a cross-section of the line shown in FIG. 9;

FIG. 9 is a cross-sectional view of the clamp actuation member shown in FIG. 8;

FIG. 10 is a cross-sectional side view of a threaded sleeve assembly for use in the connector of FIG. 1;

FIG. 11 is a cross-sectional side view of an inner mandrel for use in the threaded sleeve assembly of FIG. 10;

FIG. 12 is a cross-sectional view of the inner mandrel shown in FIG. 11;

FIG. 13 is a cross-sectional side view of a gripper ring for use in the threaded sleeve assembly of FIG. 10;

FIG. 14 is a cross-sectional plan view of the gripper ring shown in FIG. 13;

FIG. 15 is a cross-sectional side view of a threaded sleeve for use in the threaded sleeve assembly of FIG. 10;

FIG. 16 is a side view of the threaded sleeve shown in FIG. 15;

FIG. 17 is a cross-sectional plan view of the threaded sleeve shown in FIG. 15;

DETAILED DESCRIPTION OF THE PREFERRED EMBODIMENTS

This detailed description is divided into two sections. The first describes in detail a hardline connector in which the retaining feature summarized above may be used. The second describes the retaining feature itself. Those skilled in the art should appreciate that even though a hardline connector is described in detail herein, the retaining feature described thereafter could be used in a wide variety of contexts in the connector art, and possibly in other arts, and thus the invention should not in its broadest form be limited to a hardline connector, although conversely the hardline connector described herein is believed to have a number of advantageous features.

1. Hardline Connector

Figure 1:
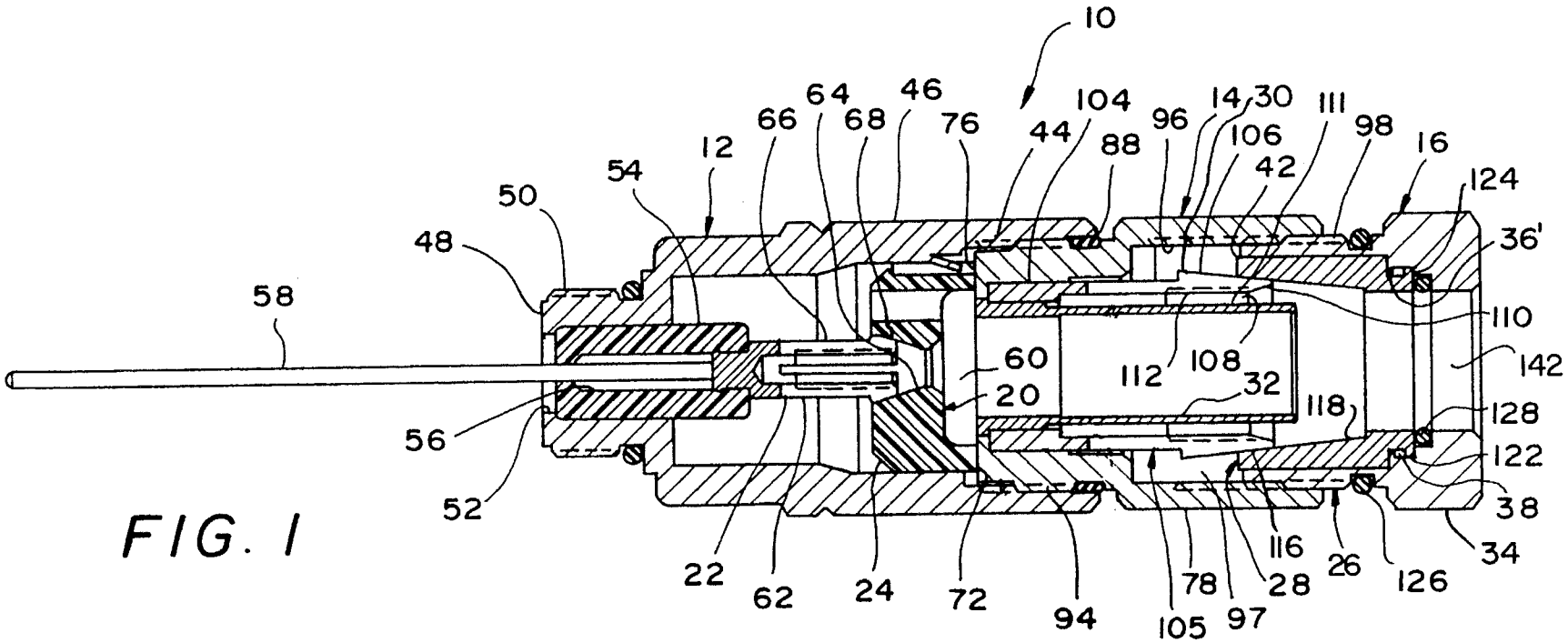
FIG. 1 is a cross-sectional side view of a three piece hardline connector constructed in accordance with the principals of a preferred embodiment of the invention.
Figure 1A:
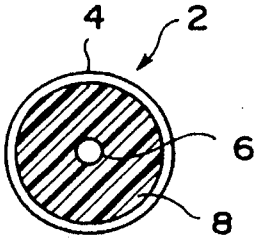

FIG. 1 shows a three-piece hardline connector constructed in accordance with the principles of a preferred embodiment of the invention. It is specifically designed for use with a hardline cable, shown in FIG. 1(A), of the type having a rigid outer conductor 4 and a center conductor 6 surrounded by a dielectric material 8, the dielectric material being removed from the end of the cable which is to be terminated to the connector.

Although the illustrated embodiment is a three-piece connector, those skilled in the art will appreciate that the invention is equally applicable to a two piece connector, and that the preferred three piece connector design may be converted to a two piece design simply by integrating the sleeve and main body of the three piece design into a single integrated member, and by adding provision as necessary for controlling the center conductor clamping force by, for example, adding a spring washer between the interface between the outer conductor gripping mechanism (or mandrel) and the center conductor clamping mechanism. Integration of the threaded sleeve and main body may be accomplished by either forming the sleeve and main body as a single member or by forming them separately and subsequently soldering or otherwise securing them together. See U.S. patent application Ser. No. 08/338,776 incorporated herein by reference for a more detailed description of a two piece hard line connector.

Turning to FIGS. 1, 2, 10 and 18, the three principal pieces of the three-piece connector 10 of the illustrated preferred embodiment are a main body assembly 12, a threaded sleeve assembly 14 and a rear nut assembly 16. The main body assembly 12 includes a center conductor clamping mechanism 20 made up of a spring contact 22 and a clamping actuator 24 illustrated in FIG. 2, while the threaded sleeve assembly 14 contains a cable gripping mechanism 26 made up of a compression ring 28, gripper ring 30 and inner mandrel 32 shown in FIG. 10. The rear nut assembly 16 contains a rear clamping nut 34 and a compression ring 28 retained in the rear clamp nut 34 by means of a trepan cold form protrusion which upon placing the compression ring 28 within the rear clamping nut 34 forms into an annular groove 38 located in the outer peripheral surface 42 of the compression ring 28, thus holding the compression ring 28 within the rear clamping nut 34.

The main body assembly 12 of the illustrated three-piece connector, best shown in FIGS. 1–9, includes a threaded rear portion 44 having internal threads to permit threading of a main body 46 onto the threaded sleeve assembly 14, and a front mating portion 48 comprising in the illustrated embodiment of a threaded section 50 for coupling to a mating connector or fitting (not shown) and an opening 52 into which is fitted a dielectric member 54 having a central passage 56, for an inner contact 58.

Those skilled in the art will appreciate that the details of this portion of the connector, in particular, are included for illustrative purposes only and may be freely varied within the scope of the invention depending on the requirements of the fitting to which the connector is intended to be connected. Thus, a more detailed description of this portion of the connector is omitted except to note that behind the dielectric member 54 is a chamber 60 sufficiently large to accommodate the center conductor clamping mechanism 20.

The center conductor clamping mechanism 20 includes a spring contact portion 62 of the contact 58 and a frustoconical cam surface 64 on the clamping actuator member 24. The spring contact portion 62 is in turn made up of resilient tines 66 between which the center conductor (not shown) is inserted before clamping. The cam surface 64 is arranged to engage corresponding semi-frustoconical surfaces 68 formed on each of the two tines when the contact is positioned in the central passage 56 and the actuator member 24 is positioned in the chamber 60 such that a rear surface 72 of the actuator member 24 (which is preferably made of plastic) engages a corresponding front surface 76 of the threaded sleeve 78 so that when the sleeve 78 is threaded on to the main body 46 there is a secure engagement between the center conductor 6 of the hard line cable 2 and the contact 58 is assured. If necessary, a spring washer (not shown) could be included to insure that the clamping mechanism 24 exerts sufficient force against the spring tines 66 and the center conductor 58.

The threaded sleeve assembly is more specifically shown in FIGS. 10–17. The threaded sleeve assembly 14 is made up four separate parts including an O-Ring 88, a threaded sleeve 78, a gripper ring 30, and an inner mandrel 32. The threaded sleeve 78 has externally threaded from portion 94 designed to engage with the internally threaded rear portion 44 of the main body 46. The threaded sleeve 78 also has a internally threaded rear portion 96 which defines an opening 97 having a diameter sufficient to enable the internally threaded rear portion 96 to receive the externally threaded front portion 98 of the rear clamping nut 34. The mandrel 32 is preferably placed within the gripper ring 30. The gripper ring 30 includes a cylindrical portion 104 designed to be positioned between the threaded sleeve and the mandrel. The gripper ring 30 also has a rearwardly extending flexible portion 105 made of individual fingers 106 which in their unstressed state, before assembly of the connector 10 to the cable 2 and tightening of the rear clamping nut 34, define an opening 108 for the outer conductor 4 of the cable 2 which provides sufficient clearance between the outer conductor 4 and the inner surfaces 110 of the fingers 106 to permit easy insertion of the outer conductor 4 into the opening 108 but which is small enough to permit the fingers 106 to engage the outer conductor 4 and press it against the cylindrical portion 111 of the inner mandrel 32 when compressed in response to movement of the compression ring 28 as explained below. The fingers 106 of the gripper ring 30 include, on inner surfaces 112, teeth shaped to penetrate the outer conductor 4 of the cable 2 and thereby prevent actual movement of the outer conductor 4 relative to the gripper ring 30 upon tightening of the rear clamping nut 34.

Figure 18:
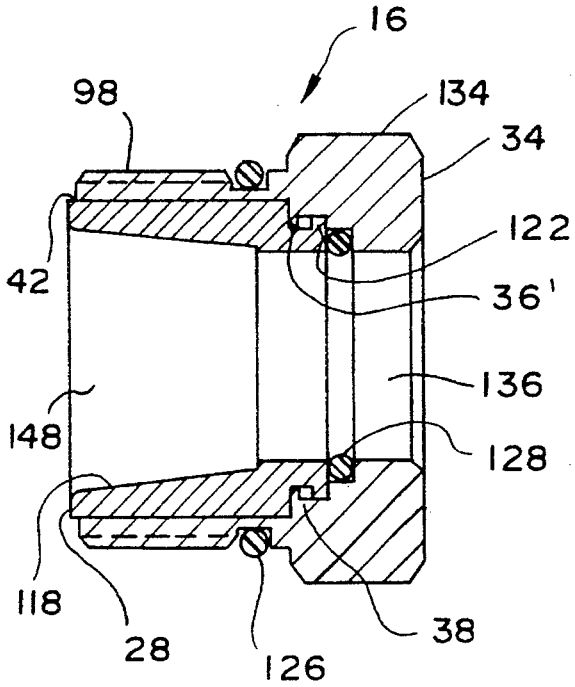
FIG. 18 is a cross-sectional side view of the rear nut assembly for use in the connector of FIG. 1.
Figure 19:
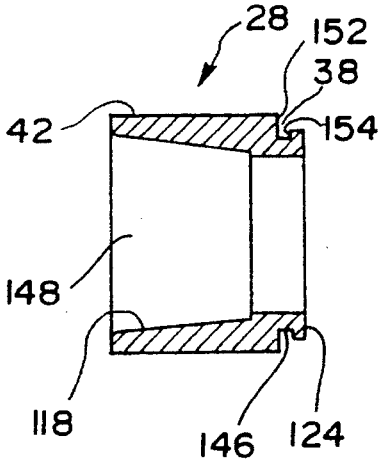
FIG. 19 is a cross-sectional side view of a compression ring for use in the rear nut assembly of FIG. 18.
Figure 20:
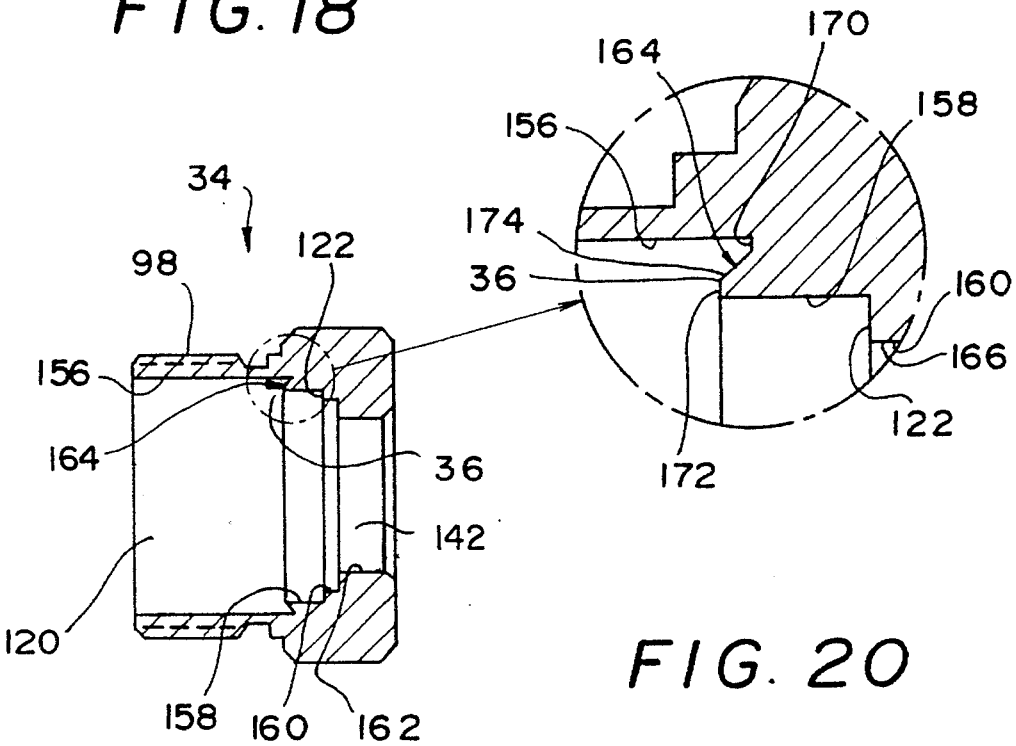
FIG. 20 is a cross-sectional view of a rear clamping nut for use in the rear nut assembly in FIG. 18.

The rear nut assembly 16 is shown in FIGS. 18–20. Fingers 106 of the gripper ring 30 also include tapered or camming surfaces 116 which cooperate with a corresponding tapered inner surface 118 of the compression ring 28 to cause the fingers 106 to flex inwardly upon tightening of the rear clamping nut 34. The advantage of including a compression ring 28 is that the ring 28 isolates fingers 106 from the twisting of the rear clamping nut 34, causing relative sliding contact between surfaces 116 and 118 to be solely in an axial direction, so long as the compression ring 28 is free to rotate relative to the rear clamping nut 34. While the diameter of opening 120 is desirably large enough to provide clearance for the compression ring 28 before tightening of the rear clamping nut 34, it would be appreciated by those skilled in the art that the diameter of opening 120 should be small enough to prevent flexing of the compression ring 28 in response to flexing of fingers 106 inwardly as the compression ring is moved axially forward by engagement between the bearing surface of the rear clamping nut 34 and the corresponding surface abutment on the compression ring 28 as the rear nut is threaded onto the sleeve 84. Outward flexing of the compression ring 28 and the surface of opening 120 in response to engagement between the tapered surfaces 116 and 118 has the additional advantage of establishing good electrical contact in order to provide a ground path between the rear clamping nut 34, which forms part of the connector shell and the rigid outer connector 4 of the cable 2.

2. Retention Feature (i) The Prior Design

Figure 21:
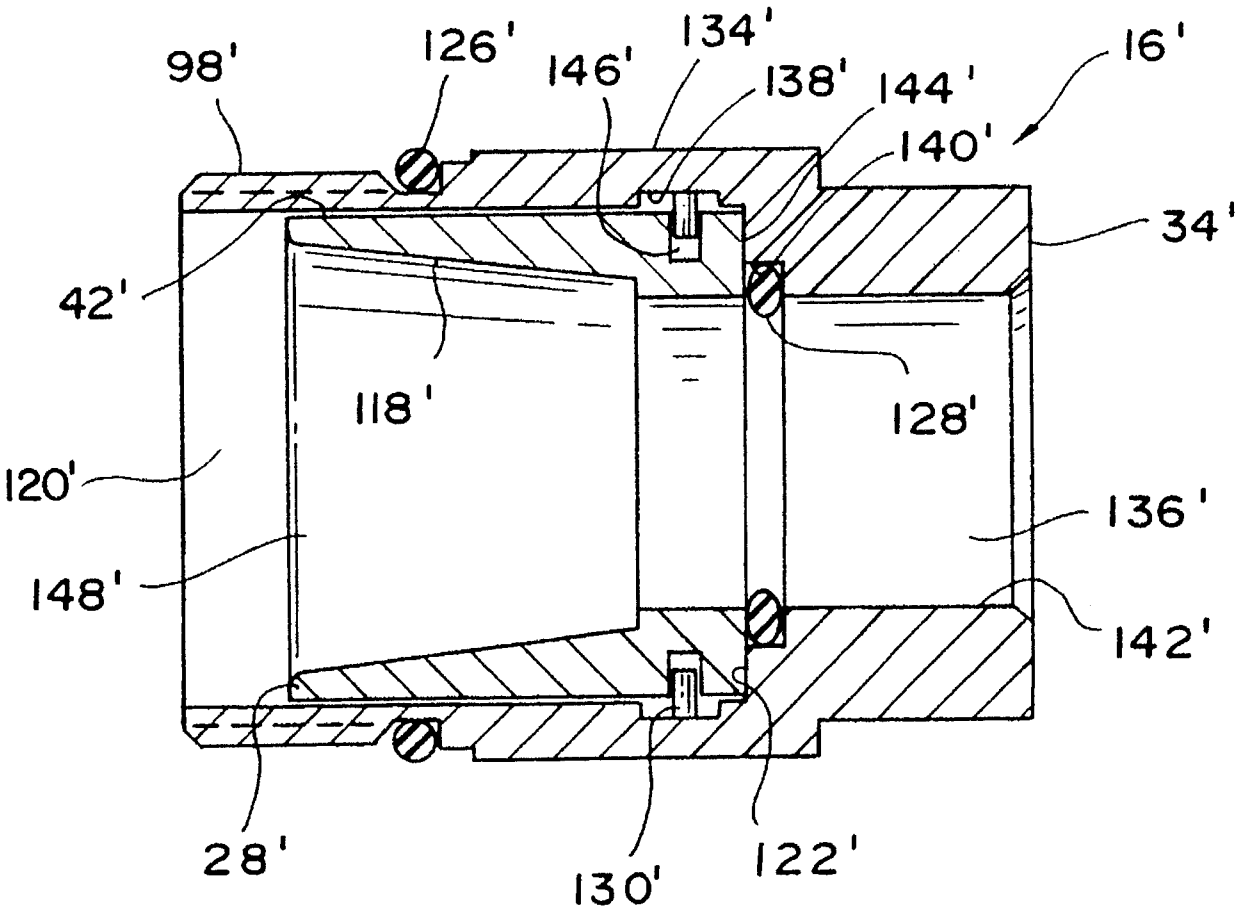
FIG. 21 PRIOR ART
FIG. 21 is a cross-sectional view of a prior art rear nut assembly.

In the past, the rear nut assembly 16 shown in FIG. 21 has been made of five distinct parts: a rear nut 34, two O rings 126 and 128, a compression ring 28, and a snap ring 130. The rear nut 34 includes a front portion having an externally threaded portion 98 which meets with the internally threaded portion of the threaded sleeve assembly. Also adjacent this external threaded portion is a recess in which is placed an O-Ring 126 in order to seal the connector from the outside environment as the threaded sleeve is attached to the back nut. Moving further to the rear of the rear nut 34 after the O-Ring 126 there is a raised portion 34 which has an outer periphery designed to cooperate with some type of wrench or other device to apply a torque to the rear nut 34 in order to twist it and thus operate the cooperating threads between the threaded sleeve assembly and the rear nut 34. Finally, at the rear portion of the nut 34 there is an opening for insertion of a CATV cable 2.

Internally, the rear nut 34 has an opening 120 at its from portion into which a compression ring 28 may be inserted. This opening 120 extends from the front end of the nut 34 towards the middle of the nut 34 at which point the nut 34 has an annular slot protruding radially outward into the surface of the opening 120. This slot 138 is adapted to contain a snap ring 130 for retaining the compression ring 28. Further along the hole 120 towards the rear of the nut are two reduced diameter portions. The first reduced diameter portion 140 is designed to hold a second O-Ring 128 and the second reduced diameter portion 138 essentially is an opening towards the back of the nut 34 which provides access for the cable 2. The interface 144 between the opening 120 at the front portion of the rear nut 34 and the first reduced diameter portion 140 provides a surface bearing 122 in order to restrict the amount which the compression ring 28 may travel in the opening 120 towards the back of the back nut. The compression ring 28 itself has a smooth outer peripheral surface having a single annular slot 146 therein towards the rear portion of the compression nut 24. This slot 142 is designed to accept the snap ring 130 such that the snap ring 130 is both in the annular slot of the back nut 34 and the annular slot 146 of the compression ring 28. At the front portion the compression ring 28 is an opening 148 having a tapered inner peripheral surface 118 designed to cooperate with the gripper ring located within the threaded sleeve assembly. This assembly is put together by first putting an O-Ring 128 in the first reduced diameter 140 portion of the rear nut 34 and then compressing the snap ring 130 within the annular slot 146 of the compression ring 28 and sliding the compression ring 28 into the opening 120 of the rear nut 34 until the snap ring 130 snaps in place. The snap ring 130 is designed to hold the compression ring 28 within the rear nut assembly 16 until the rear nut assembly 16 is attached to the threaded sleeve at which time the compression ring 28 is held in place by its cooperation between the bearing surface 122 of the rear nut 34 and the interaction of the gripper ring with the tapered surface 118 of the compression ring 28.

(ii) Modifications to the Prior Design

As stated earlier, the prior art design has many flaws in terms of its expense because it is difficult to manufacture and includes extra unnecessary parts. By the present invention, the inventor has provided a rear nut assembly 16 with a number of modifications.

First, the compression ring 28 is similar to that of the prior compression ring, including an annular slot 146 on the outer periphery, but this annular slot has a front wall 152 which extends further radially outward than the rear wall 154. As will be explained below, the reduced diameter portion 154 on the rear end of the annular ridge is necessary to allow the compression ring 28 to be assembled into the rear clamping nut 34.

The rear clamping nut 34 itself still has a forward portion with an outer threaded periphery 98 designed to cooperate with the inner threaded peripheral surface 96 of the threaded sleeve assembly 14 and also has an opening 120 with a smooth inner peripheral cylindrical surface 156 into which the compression ring 28 may be placed. However, there is no annular slot located on this smooth inner periphery 156 as it is unnecessary in the instant design. Instead, the inner periphery has three reduced diameter surfaces 158, 160, 162, the step between the smooth inner peripheral surface 156 of the front portion and the first reduced diameter portion 158 having an interface containing a trepan protrusion 36 which extends axially along the longitudinal axis of the rear clamping nut 34. The second reduced diameter portion 166 is designed to retain an O-Ring 124 on its inner peripheral surface 166 and on its axially facing peripheral bearing surface 122 and is designed to provide an abutment for the compression ring 28. The third reduced diameter portion has a smooth inner peripheral surface 168 designed to accept the cable 2.

During assembly the compression ring 28 is slid axially inside the opening 120 of the rear clamping nut 34 until the trepan annular protrusion 36 extends over the rear wall 154 of the slot in the compression ring 28 and abuts the forward wall 152 of the annular ridge. The trepan protrusion 36 is then deformed axially inward into the annular slot of the compression ring 28 until surface 152 engages surface 170, at which time the trepan protrusion has reached the position shown in FIG. 18.

In an especially preferred embodiment of the retention arrangement, the interface 164 between the interperipheral surface 156 of the front opening 120 of the rear clamping nut 34 and the first reduced diameter surface 158 of the nut 34 includes first and second radially extending surfaces (170, 172) at right angles to the inner peripheral surface 156 of the opening 120 and connected by a further interface 174 which is at approximately 45° to the first two surfaces (174, 177).

It should be noted however, that the critical factor here is the volume of the protrusion 36 as opposed to its particular shape. Any shape of the protrusion 36 will do so long as there is some angle at which the axial force provided by the compression ring 28 results in a radially inward force on the protrusion 36. Since it is believed by the inventor that the metal is not so much bent as it is cold formed and its grain structure is changed as it is deformed, the shape is not as critical as the volume. Of course, it will be appreciated that a thinner shape would be easier to form, but at the same time would be more delicate.

Finally, it is noted that a variety of different appropriate materials could be used for the rear clamping nut 34 and compression ring 28, although aluminum for the compression ring 28 and brass for the rear clamping nut 34 seem to work quite well, and that any known manufacturing method may be used to apply axial force to the compression ring 28 to place it and assemble it within the rear clamping 34. For example, a pneumatic cylinder using air pressure easily will provide sufficient force on the compression ring 28. The exact amount of force of course is not critical because the rear face 152 of the compression ring 28 will abut against the bearing surface 120 between the first and second reduced diameter portions 158,160 and therefore the trepan shape 36 will not be overly deformed.

Because the preferred embodiment may be varied or modified in a number of ways, including ways not specifically discussed above, without departing from the principles which underlie the invention, and it is intended that the invention be defined to include all such variations and modifications, those skilled in the art should note that the invention is not to be limited in any way to the preferred embodiment described herein and illustrated in the drawings, but rather should be treated as being limited solely by the appended claims.

We claim:

1. A retention assembly for two relatively movable members in an electrical connector, comprising:

a first member having a longitudinal axis, said first member having a first end portion including a first inner peripheral surface with a first diameter, a second end portion including a second inner peripheral surface with a second diameter smaller than said first diameter, a third inner peripheral surface having a third diameter smaller than said second diameter, a first radially extending axially facing interface between said first inner peripheral surface and said second inner peripheral surface, said interface including a protrusion extending axially therefrom, and a second radially extending axially facing interface between said second inner peripheral surface and said third inner peripheral surface; and a second member having a longitudinal axis adapted to fit within said first member, said second member including a first end, a second end, a tapered inner peripheral surface and a first outer peripheral surface at said first end with a fourth diameter adapted to cooperate with said first inner peripheral surface;

a second outer peripheral surface at said second end with a fifth diameter adapted to cooperate with said second inner peripheral surface, a third outer peripheral surface located between said first and second outer peripheral surfaces with a sixth diameter smaller than said fourth and fifth diameters, said third outer peripheral surface forming the bottom of a slot located in the second member between said first and second outer peripheral surfaces, said slot adapted to receive said protrusion after it is radially deformed by axial pressure, said protrusion and said slot adapted to cooperate such that the second member may move axially within said first member.

2. The assembly of claim 1, wherein said protrusion is tapered.

3. The assembly of claim 1, wherein said protrusion has less volume than said slot.

4. The assembly of claim 1, wherein said second member further includes a third radially extending axially facing interface between said first and second outer peripheral surfaces, said third interface adapted to abut said protrusion and apply axial pressure to deform said protrusion radially inward into said slot.

5. The assembly of claim 1, wherein said first member is a clamping nut of a hardline connector and said second member is a compression ring of the hardline connector.

6. A method of retaining a compression ring within a rear nut assembly for a hardline connector comprising the steps of placing the compression ring within the rear nut, applying axial force to the compression ring to form an axially extending protrusion in the rear nut into a groove located on the outer peripheral surface of the compression ring to secure the compression ring to the rear nut assembly while permitting relative axial movement between the compression ring and the rear nut assembly.

* * * * *